US011060769B2

(12) United States Patent
Oh

(10) Patent No.: US 11,060,769 B2
(45) Date of Patent: Jul. 13, 2021

(54) REFRIGERATOR

(71) Applicant: LG ELECTRONICS INC., Seoul (KR)

(72) Inventor: Minkyu Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 268 days.

(21) Appl. No.: 16/199,950

(22) Filed: Nov. 26, 2018

(65) Prior Publication Data

US 2019/0162453 A1 May 30, 2019

(30) Foreign Application Priority Data

Nov. 29, 2017 (KR) ..... 10-2017-0161616

(51) Int. Cl.
*F25B 1/00* (2006.01)
*F25B 1/02* (2006.01)
(Continued)

(52) U.S. Cl.
CPC ..... *F25B 21/02* (2013.01); *F25D 17/045* (2013.01); *F25D 17/06* (2013.01); *F25D 31/00* (2013.01); *F25D 31/005* (2013.01); *F25B 2321/0251* (2013.01); *F25D 2300/00* (2013.01); *F25D 2317/061* (2013.01); *F25D 2317/063* (2013.01);
(Continued)

(58) Field of Classification Search
CPC ..... F25B 21/02; F25B 2321/02; F25B 2321/023; F25D 17/06; F25D 17/045; F25D 17/062; F25D 17/065; F25D 31/005; F25D 2600/04; F25D 2600/06; F25D 2317/0665; F25D 2317/0682; F25D 2317/061; F25D 2317/063; F25D 2317/068; F25D 2400/02; F25D 2300/00; F25D 11/02; D06F 58/10
See application file for complete search history.

(56) References Cited

U.S. PATENT DOCUMENTS 4,380,877 A * 4/1983 Poux ..... F15D 1/001 239/556
6,679,065 B1 * 1/2004 Bessler ..... F25B 21/04 62/149
(Continued)

FOREIGN PATENT DOCUMENTS

CN 1151512 A 6/1997
CN 202002424 U 10/2011
(Continued)

*Primary Examiner* — David J Teitelbaum
*Assistant Examiner* — Heather J Huddle
(74) *Attorney, Agent, or Firm* — Denton US LLP

(57) ABSTRACT

A refrigerator includes a main body that has a storage chamber and a drying chamber; a thermoelectric module that includes a heat absorber and a heat dissipater; a cooling fan that circulates air in the storage chamber to the heat absorber and the storage chamber; a heat-dissipating fan that blows air to the heat dissipater; an air guide that has a passage for guiding air heated by the heat dissipater to the drying chamber; a heater that is disposed in the passage; and a damper that controls a flow of air in the passage between the heat-dissipating fan and the heater. Heat of the heat dissipater transfers to the drying chamber through the passage of the air guide and the damper, thereby being able to dry an object to be dried.

20 Claims, 9 Drawing Sheets

(51) Int. Cl.

| | |
|---|---|
| ***F25B 1/04*** | (2006.01) |
| ***F25B 1/047*** | (2006.01) |
| ***F25B 1/053*** | (2006.01) |
| ***F25B 1/06*** | (2006.01) |
| ***F25B 1/08*** | (2006.01) |
| ***F25B 1/10*** | (2006.01) |
| ***F25B 3/00*** | (2006.01) |
| ***F25B 5/00*** | (2006.01) |
| ***F25B 5/02*** | (2006.01) |
| ***F25B 5/04*** | (2006.01) |
| ***F25B 6/00*** | (2006.01) |
| ***F25B 6/02*** | (2006.01) |
| ***F25B 6/04*** | (2006.01) |
| ***F25B 7/00*** | (2006.01) |
| ***F25B 9/00*** | (2006.01) |
| ***F25B 9/02*** | (2006.01) |
| ***F25B 9/04*** | (2006.01) |
| ***F25B 9/06*** | (2006.01) |
| ***F25B 9/08*** | (2006.01) |
| ***F25B 9/10*** | (2006.01) |
| ***F25B 9/12*** | (2006.01) |
| ***F25B 9/14*** | (2006.01) |
| ***F25B 11/00*** | (2006.01) |
| ***F25B 11/02*** | (2006.01) |
| ***F25B 11/04*** | (2006.01) |
| ***F25B 13/00*** | (2006.01) |
| ***F25B 15/00*** | (2006.01) |
| ***F25B 15/02*** | (2006.01) |
| ***F25B 15/04*** | (2006.01) |
| ***F25B 15/06*** | (2006.01) |
| ***F25B 15/08*** | (2006.01) |
| ***F25B 15/09*** | (2006.01) |
| ***F25B 15/10*** | (2006.01) |
| ***F25B 15/12*** | (2006.01) |
| ***F25B 15/14*** | (2006.01) |
| ***F25B 15/16*** | (2006.01) |
| ***F25B 17/00*** | (2006.01) |
| ***F25B 17/02*** | (2006.01) |
| ***F25B 17/04*** | (2006.01) |
| ***F25B 17/06*** | (2006.01) |
| ***F25B 17/08*** | (2006.01) |
| ***F25B 17/10*** | (2006.01) |
| ***F25B 17/12*** | (2006.01) |
| ***F25B 19/00*** | (2006.01) |
| ***F25B 19/02*** | (2006.01) |
| ***F25B 19/04*** | (2006.01) |
| ***F25B 21/00*** | (2006.01) |
| ***F25B 21/02*** | (2006.01) |
| ***F25B 21/04*** | (2006.01) |
| ***F25B 23/00*** | (2006.01) |
| ***F25B 25/00*** | (2006.01) |
| ***F25B 25/02*** | (2006.01) |
| ***F25B 27/00*** | (2006.01) |
| ***F25B 27/02*** | (2006.01) |
| ***F25B 29/00*** | (2006.01) |
| ***F25B 30/00*** | (2006.01) |
| ***F25B 30/02*** | (2006.01) |
| ***F25B 30/04*** | (2006.01) |
| ***F25B 30/06*** | (2006.01) |
| ***F25B 31/00*** | (2006.01) |
| ***F25B 31/02*** | (2006.01) |
| ***F25B 33/00*** | (2006.01) |
| ***F25B 35/00*** | (2006.01) |
| ***F25B 35/02*** | (2006.01) |
| ***F25B 35/04*** | (2006.01) |
| ***F25B 37/00*** | (2006.01) |
| ***F25B 39/00*** | (2006.01) |
| ***F25B 39/02*** | (2006.01) |
| ***F25B 39/04*** | (2006.01) |
| ***F25B 40/00*** | (2006.01) |
| ***F25B 40/02*** | (2006.01) |
| ***F25B 40/04*** | (2006.01) |
| ***F25B 40/06*** | (2006.01) |
| ***F25B 41/00*** | (2021.01) |
| ***F25B 41/10*** | (2021.01) |
| ***F25B 41/20*** | (2021.01) |
| ***F25B 41/22*** | (2021.01) |
| ***F25B 41/24*** | (2021.01) |
| ***F25B 41/26*** | (2021.01) |
| ***F25B 41/28*** | (2021.01) |
| ***F25B 41/30*** | (2021.01) |
| ***F25B 41/31*** | (2021.01) |
| ***F25B 41/315*** | (2021.01) |
| ***F25B 41/32*** | (2021.01) |
| ***F25B 41/325*** | (2021.01) |
| ***F25B 41/33*** | (2021.01) |
| ***F25B 41/335*** | (2021.01) |
| ***F25B 41/34*** | (2021.01) |
| ***F25B 41/345*** | (2021.01) |
| ***F25B 41/35*** | (2021.01) |
| ***F25B 41/355*** | (2021.01) |
| ***F25B 41/36*** | (2021.01) |
| ***F25B 41/37*** | (2021.01) |
| ***F25B 41/375*** | (2021.01) |
| ***F25B 41/38*** | (2021.01) |
| ***F25B 41/385*** | (2021.01) |
| ***F25B 41/39*** | (2021.01) |
| ***F25B 41/40*** | (2021.01) |
| ***F25B 41/42*** | (2021.01) |
| ***F25B 41/45*** | (2021.01) |
| ***F25B 41/48*** | (2021.01) |
| ***F25B 43/00*** | (2006.01) |
| ***F25B 43/02*** | (2006.01) |
| ***F25B 43/04*** | (2006.01) |
| ***F25B 45/00*** | (2006.01) |
| ***F25B 47/00*** | (2006.01) |
| ***F25B 47/02*** | (2006.01) |
| ***F25B 49/00*** | (2006.01) |
| ***F25B 49/02*** | (2006.01) |
| ***F25B 49/04*** | (2006.01) |
| ***F25D 31/00*** | (2006.01) |
| ***F25D 17/06*** | (2006.01) |
| ***F25D 17/04*** | (2006.01) |

(52) U.S. Cl.

CPC ..... *F25D 2317/068* (2013.01); *F25D 2317/0665* (2013.01); *F25D 2317/0672* (2013.01); *F25D 2317/0682* (2013.01); *F25D 2400/02* (2013.01); *F25D 2500/00* (2013.01); *F25D 2600/04* (2013.01)

(56) References Cited

U.S. PATENT DOCUMENTS 7,260,957 B2 * 8/2007 Kalyanavaradhan ..... F25D 17/045 62/407
7,856,844 B2 * 12/2010 Kim ..... F25D 25/025 62/408

(56) References Cited

U.S. PATENT DOCUMENTS

| | | | | |
|---|---|---|---|---|
| 10,034,575 | B2 * | 7/2018 | Veltrop ..... | A47J 36/2483 |
| 2006/0188418 | A1 | 8/2006 | Park et al. | |

FOREIGN PATENT DOCUMENTS

| | | | | |
|---|---|---|---|---|
| JP | 06284990 | A | | 10/1994 |
| JP | 0857194 | A | | 3/1996 |
| JP | 08057194 | A | * | 3/1996 |
| KR | 10-1993-0023676 | A | | 12/1993 |
| KR | 1020100121334 | A | | 11/2010 |
| KR | 1020110026259 | A | | 3/2011 |

* cited by examiner

REFRIGERATOR

CROSS REFERENCE TO RELATED APPLICATION

The present application claims priority to Korean Patent Application No. 10-2017-0161616, filed on Nov. 29, 2017, the entire contents of which is incorporated herein for all purposes by this reference, under Articles 119(35) and 365(35) of U.S. Patent Law.

BACKGROUND

Field of the Disclosure

The present disclosure relates to a refrigerator and, more particularly, to a refrigerator of which storage chambers are cooled by a thermoelectric module.

Background

A refrigerator is an apparatus that prevents food from rotting and spoiling, and preserves medicine, or cosmetic by keeping them cool.

A refrigerator includes a storage chamber for keeping food, medicine, or cosmetic, and a cooling device for cooling the storage chamber.

The cooling device, for example, may be a refrigeration cycle device including a compressor, a condenser, an expansion unit, and an evaporator.

Alternatively, the cooling device, for example, may be a thermoelectric module (TEM) that uses a phenomenon in which a temperature difference is generated at both cross-sections of different metals coupled to each other when current is applied to the metals.

The refrigeration cycle device has a problem in that, while efficiency is high loud noise is generated when the compressor is driven, as compared with the thermoelectric module.

However, the thermoelectric module, when compared with the refrigeration cycle device, is low in efficiency, but has the advantage of less noise and may be used for small refrigerators, etc.

An example of a refrigerator designed such that a thermoelectric module cools the inside of the refrigerator has been disclosed in Korean Patent Application Publication No. 199309923676 A (published on Dec. 21, 1993). This refrigerator includes a refrigerator body formed by insulating walls, a thermoelectric element using an inner side of the refrigerator as a heat-absorbing surface and an outer side of the refrigerator as a heat-dissipating surface, an inner conductive block disposed to be able to transmit heat to the heat-absorbing surface of the thermoelectric element, an internal heat exchanger disposed to transmit heat by heat exchange with air inside the refrigerator to the inner conductive block, and an external heat exchanger accelerating heat dissipation of the thermoelectric element, in which the internal heat exchanger cools one storage chamber.

This refrigerator has a problem in that the heat from the thermoelectric element is dissipated out of the refrigerator through the external heat exchanger without being reused inside the refrigerator.

SUMMARY

One object is to provide a refrigerator that cools a storage chamber using a thermoelectric element, has high usability by drying a drying chamber with hot air, and consumes less power.

A refrigerator according to an embodiment of the present invention includes: a main body that has a storage chamber and a drying chamber; a thermoelectric module that includes a heat absorber and a heat dissipater; a cooling fan that circulates air in the storage chamber to the heat absorber and the storage chamber; a heat-dissipating fan that blows air to the heat dissipater; an air guide that has a passage for guiding air heated by the heat dissipater to the drying chamber; a heater that is disposed in the passage; and a damper that controls a flow of air in the passage between the heat-dissipating fan and the heater.

At least one heat dissipation hole for discharging air heated by the heat dissipater to the outside may be formed at the air guide.

The air guide may be disposed on top of the main body.

The main body may include: a drying chamber top plate having at least one intake hole through which air that has passed through the heat dissipater and the heater flows into the drying chamber; and a drying chamber bottom plate having at least one exhaust hole through which the air in the drying chamber is discharged out of the drying chamber.

The damper may include: a flow path body having a plurality of through-holes through which air flows; and a damper body interacting with the flow path body to open/close at least some of the through-holes.

The through-holes may face the heater.

The length of the damper body may be shorter than the length of the heater.

A handle may protrude from the damper body. A handle hole through which the handle movably penetrates may be formed at the air guide.

The flow path body may divide the inside of the air guide into a heat-dissipating fan space accommodating the heat-dissipating fan and a heater space accommodating the heater.

The air guide may have at least one external air suction hole through which external air is suctioned into the heat-dissipating fan space. The air guide may have at least one heat dissipation hole through which the air in the heat-dissipating fan space is discharged out of the air guide.

The damper body may close the at least one heat dissipation hole when opening some of the through-holes, and may open the heat dissipation holes when closing some of the through-holes.

The refrigerator may further include: a storage chamber temperature sensor that senses the temperature of the storage chamber; and a controller that controls the thermoelectric element, the cooling fan, the heat-dissipating fan, and the heater.

When the temperature sensed by the storage chamber temperature sensor is in a dissatisfying range and a drying mode is executed, the controller may perform a simultaneous operation that turns on the thermoelectric element, the cooling fan, and the heat-dissipating fan and keeps the heater turned off.

When the temperature sensed by the storage chamber temperature sensor is in a satisfying range and a drying mode is executed, the controller may perform an exclusive drying operation that turns on the thermoelectric element and the heat-dissipating fan, and turns on the heater.

When a turning-on time of the thermoelectric element is a set time or more and a drying mode is executed, the controller may perform a defrosting-drying operation that keeps the thermoelectric element off and turns on the cooling fan, the heat-dissipating fan, and the heater.

The damper may further include a damper body actuator that moves the damper body to a first position where the damper body opens some of the through-holes or to a second position where the damper body closes some of the through-holes.

The controller may control the damper.

When the temperature sensed by the storage chamber temperature sensor is in a dissatisfying range and a drying mode is executed, the controller may open the damper in an opening mode.

When the temperature sensed by the storage chamber temperature sensor is in a satisfying range and a drying mode is executed, the controller may open the damper in an opening mode.

When the temperature sensed by the storage chamber temperature sensor is in a dissatisfying range and a drying mode is not executed, the controller may close the damper in a closing mode.

When a turning-on time of the thermoelectric element is a set time or more and a drying mode is executed, the controller may open the damper in an opening mode.

According to an embodiment of the present invention, heat of the heat dissipater transfers to the drying chamber through the passage of the air guide and the damper, whereby it is possible to dry an object to be dried and to use waste heat of the refrigerator in order to heat the object to be dried. Accordingly, the refrigerator has high usability and power consumption may be reduced.

Further, the damper may control the amount of hot air flowing into the drying chamber, so the degree of drying or the entire drying time of the drying chamber may be controlled.

Further, a user may operate the damper body with the handle in hand, so it is possible to simply control the hot air flowing into the drying chamber.

Further, some of the air heated by the heat dissipater may be discharged out of the air guide through the heat dissipation holes formed at the air guide, so it is possible to prevent hot air from excessively flowing into the drying chamber when the drying chamber is not used or the temperature of the drying chamber is too high.

Further, air heated by the heat dissipater may be separately discharged through the top and the bottom of the refrigerator and a large amount of hot air may be quickly discharged without concentrating in a specific direction.

Further, when the temperature of the storage chamber is dissatisfied, hot air may be supplied to the drying chamber with the heater turned off, so it is possible to cool the storage chamber and dry an object to be dried at the same time while minimizing power consumption by the heater.

Further, when the temperature of the storage chamber is in a satisfying range, it is possible to dry an object to be dried with hot air using the heater while preventing overcooling of the storage chamber.

Further, it is possible to dry an object to be dried with hot air while defrosting the heat absorber, so it is possible to simultaneously perform a defrosting mode and a drying mode.

Further, since the damper body actuator drives the damper body, the amount of hot air flowing into the drying chamber may be controlled and the temperature of the drying chamber may be controlled at an optimal level.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION

Figure 1:
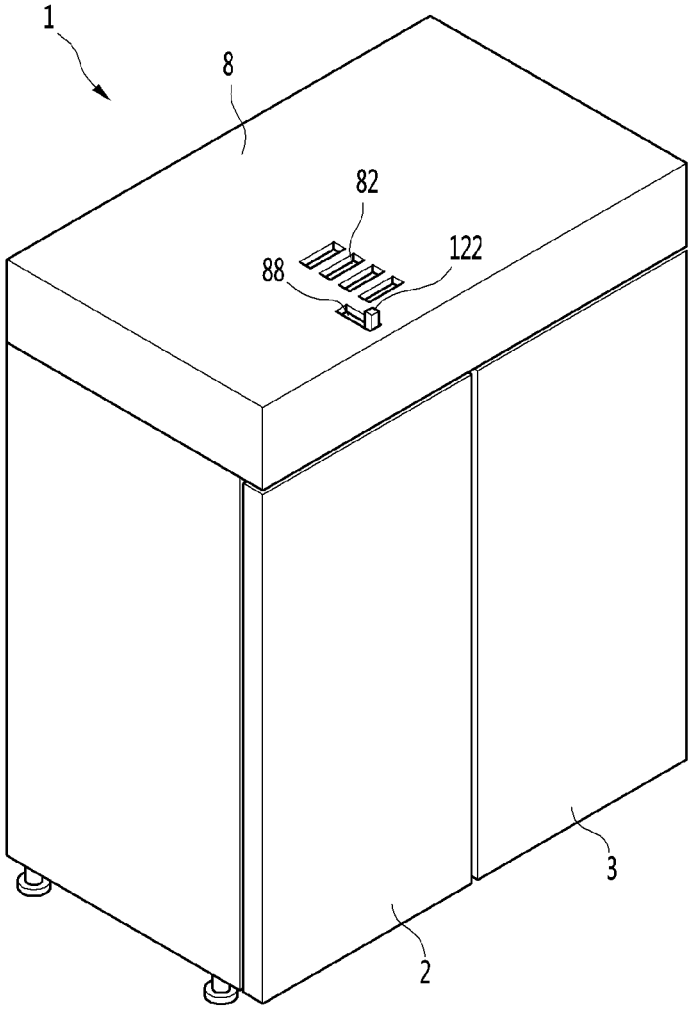
FIG. 1 is a perspective view of a refrigerator according to an embodiment of the present invention.

Hereinafter, exemplary embodiments of the present invention will be described in detail with reference to the accompanying drawings. The configuration or control method of devices to be described below are provided to describe embodiments of the present invention without limiting the scope of the present invention, and same reference numerals used throughout the specification may indicate the same components.

Figure 2:
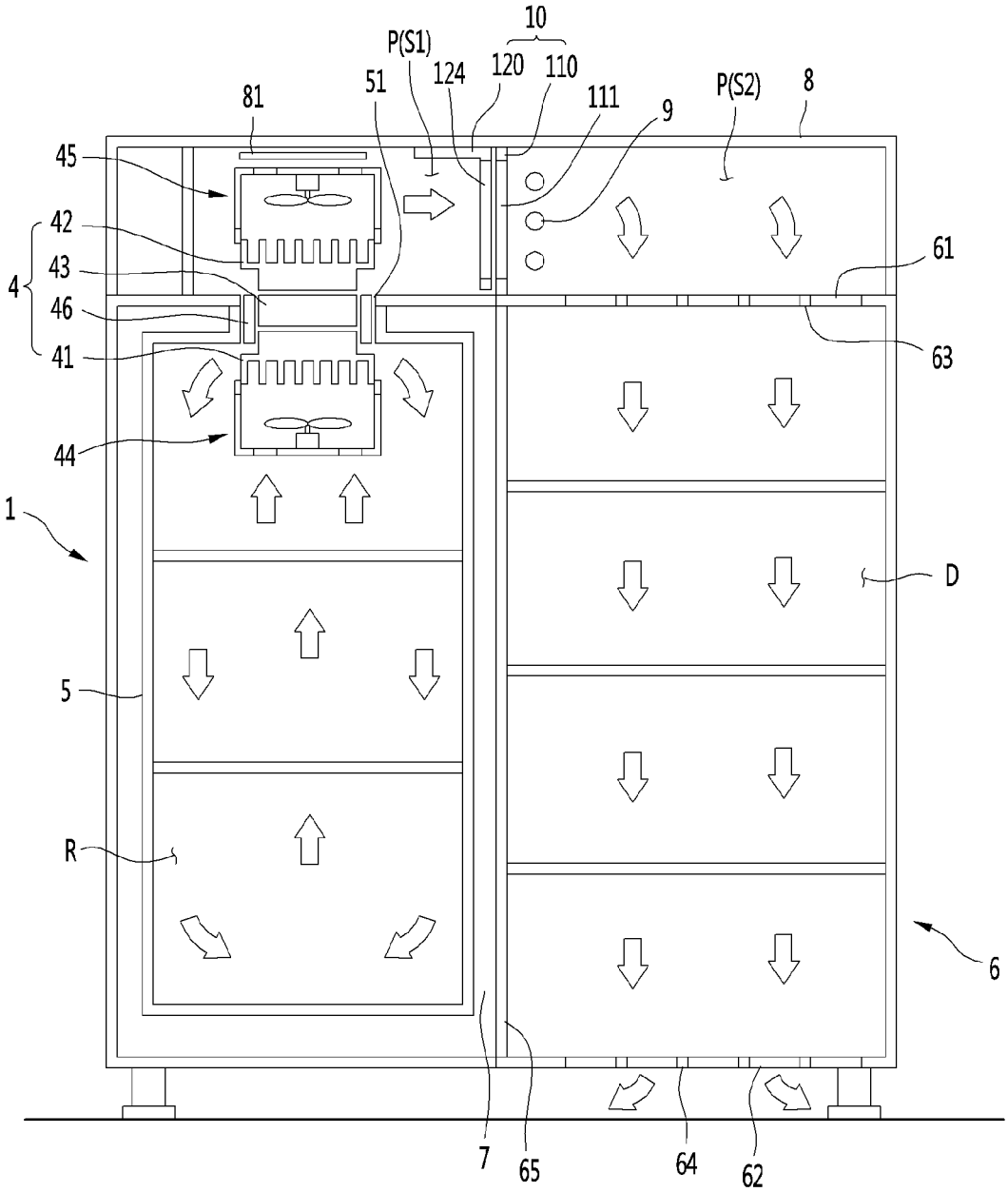
FIG. 2 is a cross-sectional view when the refrigerator according to an embodiment of the present invention is in simultaneous operation.
Figure 3:
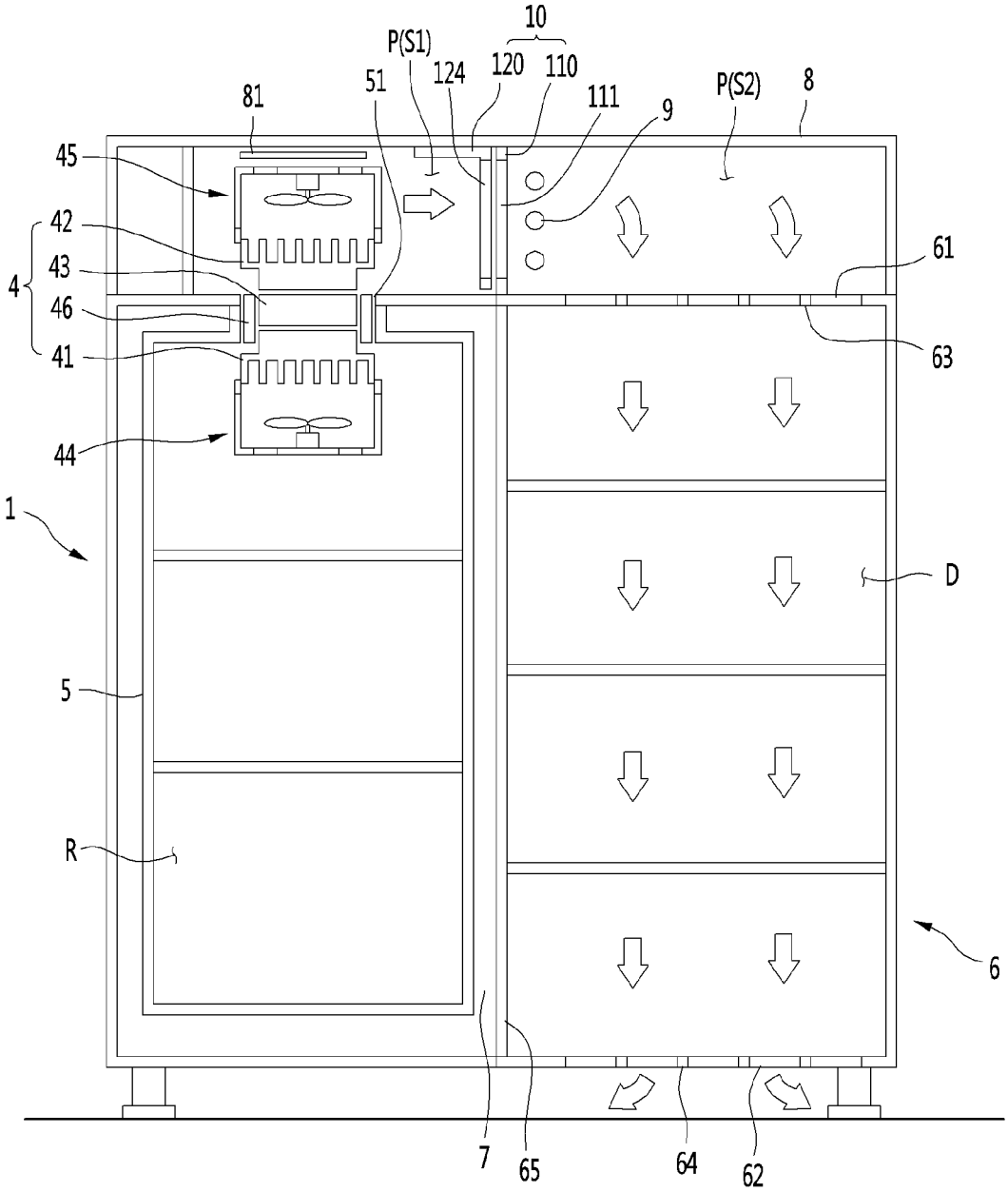
FIG. 3 is a cross-sectional view when the refrigerator according to an embodiment of the present invention is in exclusive drying operation.

FIG. 1 is a perspective view of a refrigerator according to an embodiment of the present invention, FIG. 2 is a cross-sectional view when the refrigerator according to an embodiment of the present invention is operated in a simultaneous mode, and FIG. 3 is a cross-sectional view when the refrigerator according to an embodiment of the present invention is in exclusive drying operation.

A refrigerator may include a main body 1 having a storage chamber R and a drying chamber D, a storage chamber door 2 opening/closing the storage chamber R, and a drying chamber door 3 opening/closing the drying chamber D.

The drying chamber D may be separated from the drying chamber R. Objects to be cooled that need to be kept at low temperature such as food or cosmetic may be cooled in the storage chamber R, and objects to be dried that need to be dried such as food, tableware, or clothes may be dried by hot air in the drying chamber D. The refrigerator according to the embodiment may be a dryer-refrigerator that is able to dry objects such as food, tableware, or clothes using hot air.

A thermoelectric module 4 may be mounted on the main body 1.

The thermoelectric module 4 may include a heat absorber 41 and a heat dissipater 42. The thermoelectric module 4 may include a thermoelectric element 43 disposed between the heat absorber 41 and the heat dissipater 42.

The thermoelectric element (TEM) 43, which is a component that absorbs or generates heat using Peltier effect, is an element that generates a temperature difference at both cross-sections of different metals coupled to each other when current is applied to the metals.

The thermoelectric element 43 may have a cold side and a hot side and the temperature difference between the cold side and the hot side may depend on the voltage that is applied to the thermoelectric element 43.

The heat absorber 41 may be in contact with the cold side of the thermoelectric element 43 and may be a cooling block that absorbs heat of the storage chamber R.

The heat dissipater 42 may be in contact with the hot side of the thermoelectric element 43 and may be a heat sink that absorbs and dissipates heat of the thermoelectric element 43.

The heat absorber 41 may be disposed on the bottom or the top of the thermoelectric element 43. When the heat absorber 41 is disposed on the bottom of the thermoelectric element 43, the heat dissipater 42 may be disposed on the top of the thermoelectric element 43. When the heat absorber 41 is disposed on the top of the thermoelectric element 43, the heat dissipater 42 may be disposed on the bottom of the thermoelectric element 43.

A cooling fan 44 that circulates air in the storage chamber R to the heat absorber 41 and the storage chamber R may be disposed in the in the storage chamber R. A heat-dissipating fan 45 blowing air to the heat dissipater 42 may be disposed in the main body 1. The heat-dissipating fan 45 may send the air outside the refrigerator to the heat dissipater 42 and the air sent to the heat dissipater 42 from the outside of the refrigerator may absorb heat of the heat dissipater 42.

The thermoelectric module 4 may further include a thermoelectric element frame 46 surrounding the outer side of the thermoelectric element 43. The thermoelectric element frame 46 may include an insulator.

The refrigerator may be a dryer-refrigerator that cools the storage chamber R using the thermoelectric element 43 and dries the drying chamber D using hot air dissipated by the heat dissipater 42. The heat absorber 41 absorbs heat of the storage chamber R and the heat of the heat dissipater 42 is used to dry objects to be dried in the drying chamber D through hot air.

The main body 1 may include a storage chamber case 5 providing the storage chamber R and a drying chamber case 6 providing the drying chamber D.

The storage chamber case 5 may open on a side and the drying chamber case 6 may open on a side.

The storage chamber case 5 may be opened from the front.

The storage chamber case 5 may have an opening 51 in which the heat absorber 41 and the thermoelectric element 43 are positioned. The opening 51 may be formed on sides other than the front of the storage chamber case 5. When the thermoelectric module 4 is disposed on the rear of the storage chamber case 5, the opening 51 may be formed through the rear of the storage chamber case 5 to be open in the front-rear direction. When the thermoelectric module 4 is disposed on a side of the storage chamber case 5, the opening 51 may be formed through the side of the storage chamber case 5 to be open in the left-right direction. When the thermoelectric module 4 is disposed on the top or the bottom of the storage chamber case 5, the opening 51 may be formed through the top or the bottom of the storage chamber case 5 to be open in the up-down direction.

The thermoelectric element 43 and the thermoelectric element frame 46 may be disposed in the opening 51.

The drying chamber case 6 may be disposed by the side, over, or under the storage chamber case 5.

It is exemplified in the following description that the drying chamber case 6 is disposed by the side of the storage chamber case 5. However, the drying chamber case 6 need not necessarily be disposed by the side of the storage chamber case 5, and it may be disposed over or under the storage chamber case 5.

At least one intake hole 61 through which the air heated by the heat dissipater 42 flows into the drying chamber D is formed in the drying chamber case 6. At least one exhaust hole 62 through which the air in the drying chamber D is discharged out of the refrigerator may be formed in the drying chamber case 6.

The at least one intake hole 61 and the at least exhaust hole 62 may be formed apart from each other in the drying chamber case 6.

When the at least one intake hole 61 is formed through a drying chamber top plate 63 of the drying chamber case 6, the at least one exhaust hole 62 may be formed through a drying chamber bottom plate 64 of the drying chamber case 6.

The drying chamber case 6 may have a drying chamber-surrounding plate 65 connecting the drying chamber top plate 63 and the drying chamber bottom plate 64.

The main body 1 may further include an insulator 7 disposed between the storage chamber case 5 and the drying chamber case 6. The insulator 7 can minimize heat transfer between the storage chamber R and the drying chamber D.

The insulator 7 may be disposed between a side of the storage chamber case 5 and the drying chamber-surrounding plate 65.

A passage P that guides the air sent by the heat-dissipating fan 45 into the drying chamber D may be formed in the refrigerator. The refrigerator may include an air guide 8 and the passage P that guides the air heated by the heat dissipater 42 into the drying chamber D may be formed inside the air guide 8.

The heat-dissipating fan 45 may blow external air to the heat dissipater 42 and the air may flow through the passage P after exchanging heat with the heat dissipater 42.

The air guide 8 may be disposed to face the storage chamber case 5 and the drying chamber case 6.

The air guide 8 may be elongated left and right over the storage chamber case 5 and the drying chamber case 6, and in this case, the air guide 8 faces the top of the storage chamber case 5 and the top of the drying chamber case 6.

The air guide 8 may be elongated left and right behind the storage chamber case 5 and the drying chamber case 6, and in this case, the air guide 8 faces the rear of the storage chamber case 5 and the rear of the drying chamber case 6.

A heat-dissipating fan space S1 in which the heat-dissipating fan 45 is accommodated may be defined in the air guide 8. The heat dissipater 42 of the thermoelectric module 4 and the heat-dissipating fan 45 both may be accommodated in the heat-dissipating fan space S1.

A heater space S2 may be defined in the air guide 8. A heater 9 to be described below may be accommodated in the heater space S2.

At least one external air suction hole 81 through which air outside the refrigerator is suctioned to the heat dissipater 42 may be formed at the air guide 8. The at least one external air suction hole 81 may be formed such that external air is suctioned into the heat-dissipating fan space S1.

At least one Heat dissipation hole 82 (see FIG. 1) through which the air heated by the heat dissipater 42 is discharged to the outside may be formed at the air guide 8.

The at least one heat dissipation hole 82 may be formed such that the air in the heat-dissipating fan space S1 is discharged outside. The at least one heat dissipation hole 82 may communicate with the heat-dissipating fan space S1.

The at least one heat dissipation hole 82 may be formed at positions where the air in the heat-dissipating fan space S1 may be discharged out of the refrigerator, and they may be formed through at least one of the front, the top, the rear, and the sides of the air guide 8.

The refrigerator may include the heater 9 disposed in the passage P. In this embodiment, the heater 9 may be disposed in the air guide 8 in the heater space S2. However, the heater may also be disposed in the heat-dissipating fan space S1. The heater 9 can heat the air blown by the heat-dissipating fan 45.

The heater 9 may be a heat source that heats air flowing into the drying chamber D together with the heat dissipater 42.

When the thermoelectric element 43 is turned on, the heater 9 may also be turned on, and in this case, the heat of the heat dissipater 42 and the heat of the heater 9 may heat the air flowing toward the drying chamber D. In this case, the heater 9 may be a sub-heat source that assists the heat dissipater 42.

The heater 9 may be turned on when the thermoelectric element 43 is turned off, and in this case, the heat of the heater 9 may heat the air flowing toward the drying chamber D and the heater 9 may be a main heat source that dries the drying chamber D with hot air.

The heater 9 may be turned off when the thermoelectric element 43 is turned on, and in this case, the heat of the heat dissipater 42 may heat the air flowing toward the drying chamber D. In this case, the refrigerator may supply hot air to the drying chamber D while minimizing power consumption.

Meanwhile, the refrigerator may further include a damper 10 controlling the passage P. The damper 10 may be disposed in the air guide 8. The damper 10 may be disposed in the air guide 8 to divide the passage P, that is, the damper 10 may divide the passage P, particularly, the inside of the air guide 8 into the heat-dissipating fan space S1 and the heater space S2.

In this embodiment, the damper 10 may be disposed between the heat-dissipating fan 45 and the heater 9 in the flow direction of air flowing through the air guide 8. The damper 10 may control the passage P between the heat-dissipating fan 45 and the heater 9. The damper 10 may control the flow rate of air flowing into the heater space S2 from the heat-dissipating fan space S1.

Figure 4:
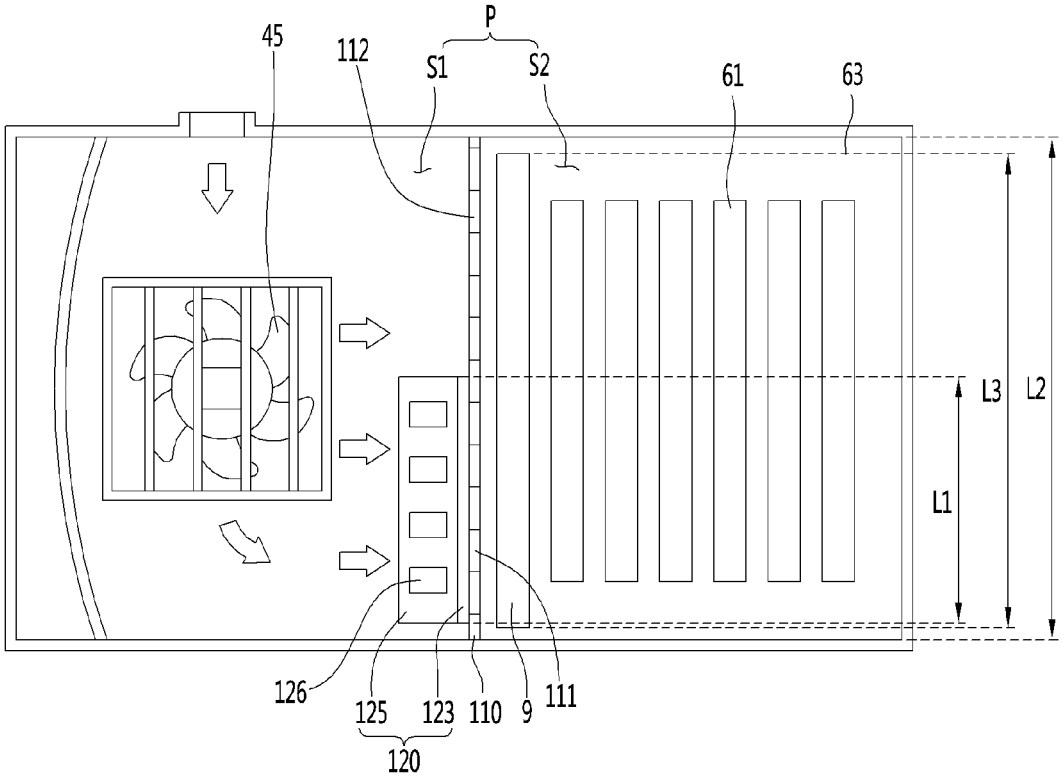
FIG. 4 is a plan view showing an inside of an air guide according to an embodiment of the present invention.
Figure 5:
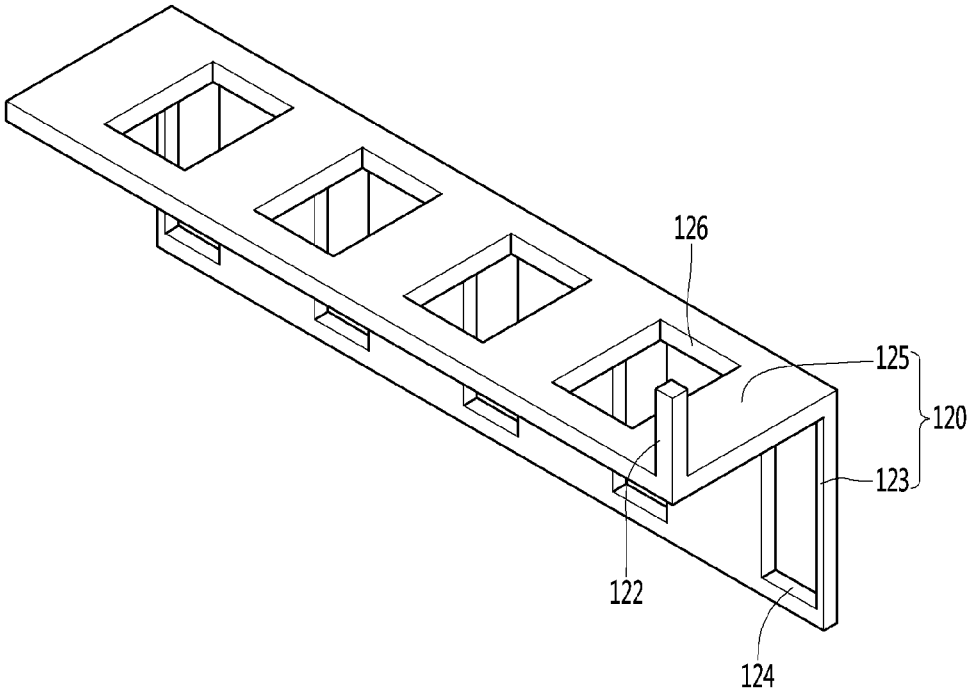
FIG. 5 is a perspective view of a damper body according to an embodiment of the present invention.
Figure 6:
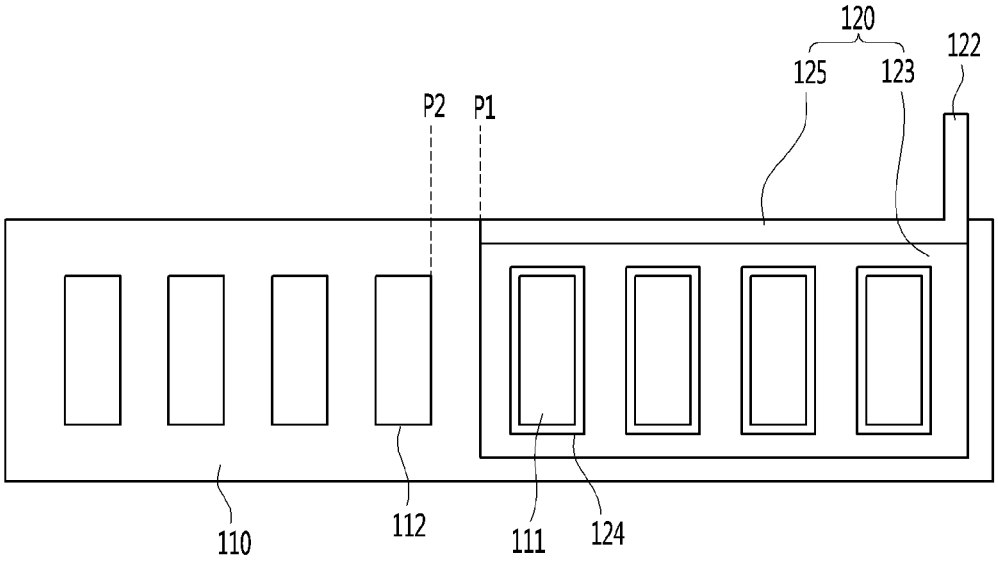
FIG. 6 is a side view when the damper body according to an embodiment of the present invention opens some of a plurality of through-holes.
Figure 7:
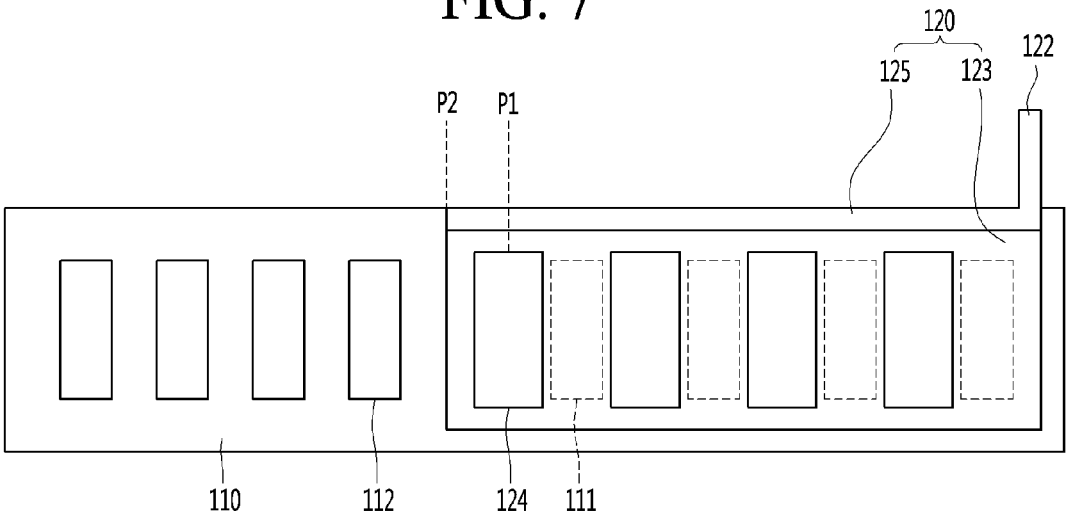
FIG. 7 is a side view when the damper body according to an embodiment of the present invention closes some of a plurality of through-holes.
Figure 8:
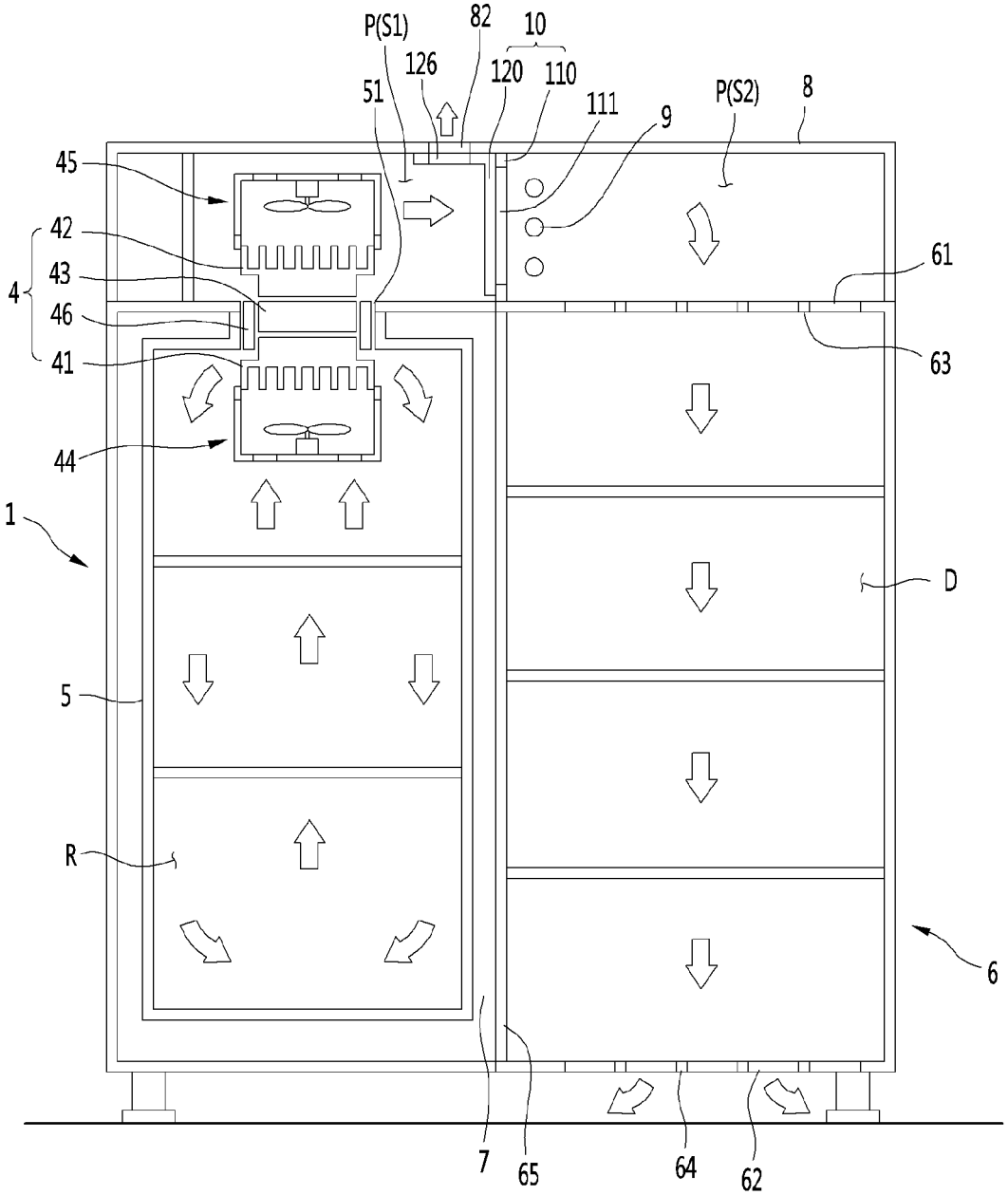
FIG. 8 is a cross-sectional view showing the inside of the refrigerator when the heat dissipation holes shown in FIG. 1 are open.

FIG. 4 is a plan view showing an inside of the air guide according to an embodiment of the present invention, FIG. 5 is a perspective view of a damper body according to an embodiment of the present invention, FIG. 6 is a side view when the damper body according to an embodiment of the present invention opens some of a plurality of through-holes, FIG. 7 is a side view when the damper body according to an embodiment of the present invention closes some of a plurality of through-holes, and FIG. 8 is a cross-sectional view showing the inside of the refrigerator when the heat dissipation holes shown in FIG. 1 are open.

The damper 10 may include a flow path body 110 and a damper body 120.

The flow path body 110 may be disposed in the air guide 8.

The flow path body 110 may divide the inside of the air guide 8 into the heat-dissipating fan space S1 and the heater space S2.

The flow path body 110 may be elongated in the air guide 8 perpendicularly to the longitudinal direction of the air guide 8. When the air guide 8 is elongated in the left-right direction, the flow path body 110 may be elongated in the front-rear direction.

At least one through-hole through which air may pass may be formed at the flow path body 110. A single through-hole or a plurality of through-holes may be formed at the flow path body 110. A plurality of through-holes 111 and 112 through which air passes may be formed at the flow path body 110.

The through-holes 111 and 112 may connect the heat-dissipating fan space S1 and the heater space S2 to each other, so air blown by the heat-dissipating fan 45 may flow into the heater space S2 through the through-holes 111 and 112.

The damper body 120 may adjust the amount of air flowing into the heater space S2 from the heat-dissipating fan space S1 by opening/closing the through-holes 111 and 112.

When a single through-hole is formed at the flow path body 110, the damper body 120 may be moved to adjust an open area of the through-hole.

When a plurality of through-holes are formed at the flow path body 110, the damper body 120 may be moved to adjust an open area of each the through-holes. The damper body 120 may be moved to simultaneously open or close the plurality of through-holes.

The damper body 120 may open/close at least some through-holes 111 among the through-holes 111 and 112.

The damper body 120 may be configured to open/close all of the through-holes 111 and 112 or may be configured to open/close only some of the through-holes 111 and 112.

The damper body 120 may be movably disposed at at least one of the air guide 8 and the flow path body 110.

When the damper body 120 opens/closes the through-holes 111 among the through-holes 111 and 112, the through-holes 111 and 112 may be divided into first through-holes 111 that are opened/closed by the damper body 120 and second through-holes 112 that are not opened/closed by the damper body 120.

The damper body 120 may be disposed to selectively open/close the through-holes 111 among the through-holes 111 and 112 and the heat dissipation holes 82.

The damper body 120 may close the heat dissipation holes 82 when the through-holes 111 of the through-holes 111 and 112 are opened, and as shown in FIG. 8, it may open the heat dissipation holes 82 when the through-holes 111 among the through-holes 111 and 112 are closed.

The damper body 120, as shown in FIG. 6, may be moved to a first position P1 where it opens the through-holes 111 among the through-holes 111 and 112 and closes the heat dissipation holes 82.

The damper body 120, as shown in FIGS. 7 and 8, may be moved to a second position P2 where it closes the through-holes 111 among the through-holes 111 and 112 and opens the heat dissipation holes 82.

The damper body 10 may be a common damper that alternately opens/closes the through-holes 111 among the through-holes 111 and 112 and the heat dissipation holes 82.

The present invention is not limited to the configuration in which one damper body 120 opens/closes the through-holes 111 among the through-holes 111 and 112 and the heat dissipation holes 82, and may be configured in which a through-hole-exclusive damper opens/closes the through-holes 111 among the through-holes 111 and 112 and a heat dissipation hole-exclusive damper that opens/closes the heat dissipation holes 82.

When one damper 10 is a common damper, the number of parts may be minimized, and hereafter, it is exemplified that the damper 10 is a common damper that selectively opens/closes the through-holes 111 among the through-holes 111 and 112 and the heat dissipation holes 82.

The damper 10 may be a manual damper that may be operated by a user, and in this case, a handle 122 (see FIGS. 1 and, 5 to 7) that a user holds may be formed on the damper body 120. The handle 122 may protrude from the damper body 120.

A handle hole 88 (see FIG. 1) through which the handle 122 penetrates may be formed at the air guide 8. The handle hole 88 may be elongated in the movement direction of the damper body 120. When the damper body 120 is designed to be moved straight in the front-rear direction, the handle hole 88 may be elongated in the front-rear direction.

Referring to FIG. 4, the length L1 of the damper body 120 may be shorter than the length L2 of the flow path body 110. The length L3 of the heater 9 may be shorter than the length L2 of the flow path body 110. The length L1 of the damper body 120 may be shorter than the length L3 of the heater 9. The length L1 of the damper body 120, the length L2 of the flow path body 110, and the length L3 of the heater 9 may be the lengthwise lengths and may be front-rear direction lengths.

The damper body 120, referring to FIGS. 5 to 7, may have a first shutter 123 that opens/closes the first through-holes 111. First connection holes 124 may be formed at the first shutter 123 so that the air in the heat-dissipating fan space S1 flows through the first through-holes 111.

When the first connection holes 124 are aligned with the first through-holes 111, the damper body 120 opens the first through-holes 111, as shown in FIG. 6. In contrast, when the portions between the first connection holes 124 are aligned with the first through-holes 111, the damper body 120 closes the first through-holes 111, as shown in FIG. 7.

The damper body 120 may have a second shutter 125 that opens/closes the heat dissipation holes 82. Second connection holes 126 (see FIGS. 5 and 8) may be formed at the second shutter 125 so that the air in the heat-dissipating fan space S1 flows through the heat dissipation holes 82.

When the second connection holes 126 are aligned with the heat dissipation holes 82, the damper body 120 opens the heat dissipation holes 82, as shown in FIG. 8. In contrast, when the portions between the second connection holes 126 are aligned with the heat dissipation holes 82, the damper body 120 closes the heat dissipation holes 82.

When the first connection holes 124 of the damper body 120 open the first through-holes 111, the portions between the second connection holes 126 may be aligned with the heat dissipation holes 82, so when the first through-holes 111 are opened, the heat dissipation holes 82 may be closed.

When the first connection holes 124 of the damper body 120 close the first through-holes 111, the second connection holes 126 may be aligned with the heat dissipation holes 82, as shown in FIG. 8, so when the first through-holes 111 are closed, the heat dissipation holes 82 may be opened.

When the damper 10 is positioned such that the damper body 120 opens the first through-holes 111, it may be defined that the damper 10 is open, and when it is positioned such that the damper body 120 closes the first through-holes 111, it may be defined that the damper 10 is closed.

When the damper 10 is opened, a large amount of hot air may be supplied into the drying chamber D, and when it is closed, some of hot air is discharged through the heat dissipation holes 82, so the hot air flowing into the drying chamber D may be reduced.

A sliding guide (or a guide rail) that guides movement of the damper body 120 may be formed on at least one of the air guide 8 and the flow path body 110.

The sliding guide may be elongated in the movement direction of the damper body 120.

The sliding guide may include a first sliding guide formed at the flow path body 110 to guide the first shutter 123. The first sliding guide may protrude from a side of the flow path body 110. The first sliding guide may be formed to have an L-shaped cross-section on a side of the flow path body 110 and may guide the lower end of the first shutter 123 in the longitudinal direction of the damper body 120.

The sliding guide may include a second sliding guide formed at the air guide 8 to guide the second shutter 125. The second sliding guide may protrude from the inner side of the air guide 8. The second sliding guide may be formed to have an L-shaped cross-section on the bottom of the top of the air guide 8 and may guide the side end of the second shutter 125 in the longitudinal direction of the damper body 120.

The heater 9 may be disposed to face the through-holes 111 and 112.

All of the through-holes 111 and 112 of the flow path body 110 may face the heater 9. When the first through-holes 111 are opened, air may be distributed between the first through-holes 111 and the second through-holes 112, and the air that has passed through the first through-holes 111 and the air that has passed through the second through-holes 112 may pass through the heater 9.

When the first through-holes 111 are closed, air cannot pass through the first through-holes 111, but air that has passed through the second through-holes 112 may pass through the heater 9.

In order to dry an object to be dried using the refrigerator, a user may adjust the amount of air flowing into the drying chamber D by operating the handle 122.

The user may hold the handle 122 and move the damper body 120 and the open areas of the first through-holes 111 may be adjusted in accordance with the position of the damper body 120.

The user may want quick drying of an object to be dried, and in this case, the user may move the handle 122 to a position where the damper body 120 maximally opens the first through-holes 111.

When the user opens the first through-holes 111, as described above, the air that has passed through the heat dissipater 42 may flow into the heater space S2 after passing through all of the first through-holes 111 and the second through-holes 112 from the heat-dissipating fan space S1, and then may flow into the drying chamber D.

As described above, when the air that has passed through the heat dissipater 42 passes through all of the first through-holes 111 and the second through-holes 112, a large amount of air may flow into the drying chamber D, so the object to be dried in the drying chamber D may be quickly dried.

The user may want slow drying of an object to be dried, and in this case, the user may move the handle 122 to a position where the damper body 120 closes the first through-holes 111.

When the user closes the first through-holes 111, as described above, the air that has passed through the heat dissipater 42 does not pass through the first through-holes 111, while the air that has passed through the second through-holes 112 from the heat-dissipating fan space S1 flows into the heater space S2, and then may flow into the drying chamber D.

When the air in the heat-dissipating fan space S1 cannot pass through the first through-holes 111, the heat dissipation holes 82 are open, so the amount of air, which is discharged through the heat dissipation holes 82, from the air in the heat-dissipating fan space S1 may be increased. Accordingly, a smaller amount of air may flow into the drying chamber D than when the first through-holes 111 are open. The object to be dried in the drying chamber D may be dried more slowly than compared with when the first through-holes 111 are open.

That is, the drying temperature of an object to be dried by hot air and the entire drying time of an object to be dried may depend on the user who holds and operates the handle 122.

Figure 9:
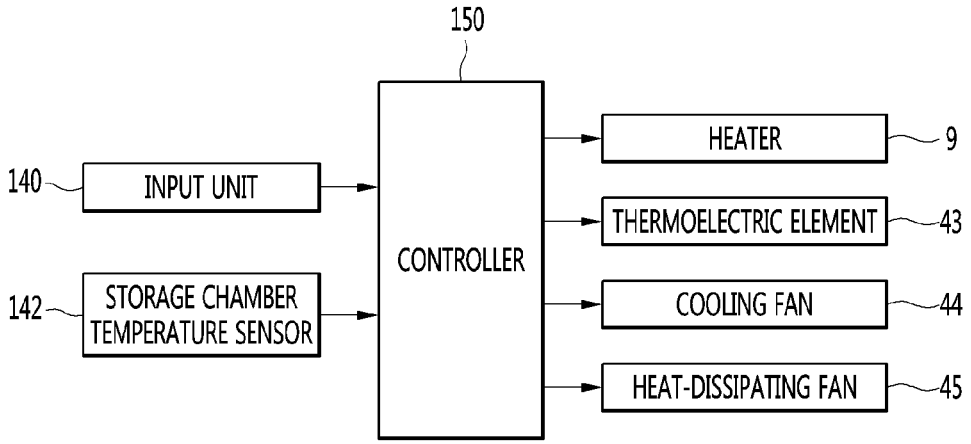
FIG. 9 is a control block diagram of the refrigerator according to an embodiment of the present invention.

FIG. 9 is a control block diagram of the refrigerator according to an embodiment of the present invention.

The refrigerator may include an input unit 140 enabling a user to operate the refrigerator. The input unit 130 may be configured such that a desired temperature of the storage chamber R may be inputted and a drying mode may be selected and started. The input unit 140 may be configured such that a user may set a drying time in the drying mode.

The refrigerator may further include a storage chamber temperature sensor 142 that senses the temperature of the storage chamber R.

The refrigerator may further include a controller 150. The controller 150 includes a microprocessor based electronic circuit, a logical electronic circuit and/or integrated circuit.

The controller 150 controls the thermoelectric element 43, the cooling fan 44, the heat-dissipating fan 45, and the heater 9. The controller 150 may control the thermoelectric element 43, the cooling fan 44, the heat-dissipating fan 45, and the heater 9 in accordance with the temperature of the storage chamber R, a defrosting condition, and/or an input of the drying mode through the input unit 140.

The defrosting condition may depend on the time during which the thermoelectric element 43 is turned on, and the controller 150 may control the thermoelectric element 43, the cooling fan 44, the heat-dissipating fan 45, and the heater 9 in accordance with the temperature of the storage chamber R, the time during which the thermoelectric element 43 is turned on, and an input of the drying mode through the input unit 140.

When the temperature sensed by the storage chamber temperature sensor 142 is in a range that does not satisfy a target temperature, the temperature of the storage chamber R may be dissatisfactory.

When the temperature sensed by the storage chamber temperature sensor 142 is in a range that does not satisfy a target temperature, the refrigerator may go into a cooling mode that cools the storage chamber R and the controller 150 may control the refrigerator in the cooling mode such that the storage chamber R is cooled by the heat absorber 41. In the cooling mode, the controller 150 may turn on the thermoelectric element 43, the cooling fan 44, and the heat-dissipating fan 45.

On the contrary, when the temperature sensed by the storage chamber temperature sensor 142 is in a range that satisfies a target temperature, the temperature of the storage chamber R may be satisfactory.

When the temperature sensed by the storage chamber temperature sensor 142 is in a range that satisfies a target temperature, the refrigerator may be in a non-cooling mode that does not cool the storage chamber R and the controller 150 may control the refrigerator in the non-cooling mode such that the storage chamber R is not cooled by the heat absorber 41. In the non-cooling mode, the controller 150 may keep the thermoelectric element 43 and the cooling fan 44 off.

When the defrosting condition is satisfied, the refrigerator may be in a defrosting mode. When the turning-on time of the thermoelectric element 43 is a set defrosting time or more, the refrigerator may be in the defrosting mode that defrosts the heat absorber 41. The controller 150 may control the refrigerator in the defrosting mode such that the heat absorber 41 is naturally defrosted by the air in the storage chamber R.

In the defrosting mode, the controller 150 may turn off the thermoelectric element 43 and turn on the cooling fan 44.

According to an embodiment, it is possible to control the defrosting mode in priority to the cooling mode, and when the defrosting condition is satisfied, it is possible to start the defrosting mode regardless of the temperature in the storage chamber R.

According to an embodiment, when a user inputs an instruction to start drying after inputting a drying function, it is possible to start the drying mode. In the drying mode, it is possible to supply hot air to the drying chamber D during a set drying time.

The drying mode is a mode that supplies hot air to the drying chamber D for a drying time (e.g., 1 to 3 hours) set by a user. The drying mode may be performed for a predetermined set drying time without a user setting a drying time. In the drying mode, the controller 150 may control the refrigerator such that hot air flows into the drying chamber D.

In the drying mode, the controller 150 may control the refrigerator in various ways.

In the drying mode, for example, the controller 150 may turn on the thermoelectric element 43 and the heat-dissipating fan 45 and keep the heater 9 off. In the drying mode, for example, it is possible to supply hot air to the drying chamber D with the heater 9 off, and thus it is possible to minimize power consumption by the refrigerator.

In the drying mode, for example, the controller 150 may turn on the heat-dissipating fan 45 and the heater 9 and keep the thermoelectric element 43 off. In this case, overcooling of the storage chamber R by the thermoelectric element 43 in the refrigerator may be minimized and the drying chamber D may be dried with hot air by the heater 9.

In the drying mode, for example, the controller may turn on all the thermoelectric element 43, the heat-dissipating fan 45, and the heater 9. In this case, the air preheated by the heat dissipater 42 may be heated again by the heater 9 and then supplied to the drying chamber D, high-temperature hot air may be supplied to the drying chamber D, and the drying chamber D may be quickly dried by hot air. As described above, when the thermoelectric element 43 and the heater 9 are both turned on, the air preheated by the heat dissipater 42 is heated by the heater 9, so load on the heater 9 may be reduced and power consumption by the heater 9 may be minimized.

In the drying mode, the controller 150 may also turn on/off the heater 9 with the thermoelectric element 43 turned on. The refrigerator may further include a temperature sensor that senses the temperature of the air flowing to the drying chamber D. When the temperature sensed by the temperature sensor with the thermoelectric element 43 turned on is less than a target temperature range of the drying chamber, the controller 150 may turn on the heater 9 so that high-temperature hot air may be supplied to the drying chamber D. When the temperature sensed by the temperature sensor with the thermoelectric element 43 and the heater 9 turned on is in the target temperature range of the drying chamber, the controller 150 may turn off the heater 9. By controlling the thermoelectric element 43 and the heater 9 in ways as described above, an object to be dried in the drying chamber D may be dried at an optimal temperature by hot air.

According to an embodiment, the target temperature of the drying chamber D may depend on an object to be dried or input by a user. The thermoelectric element 43 and the heater 9 can be controlled together in a drying mode with a high target temperature. Further, only the thermoelectric element 43 can be turned on and the heater 9 can keep turned off in a drying mode with a relatively low target temperature.

A plurality of operations of the refrigerator are described hereafter.

Depending on the temperature of the storage chamber R and the drying mode, the refrigerator may be in a cooling mode and a drying mode and may be in a defrosting mode and a drying mode.

The refrigerator may be operated in various combinations in accordance with the cooling mode, the defrosting mode, and the drying mode, and may be selectively operated in various modes such as a simultaneous operation, an exclusive drying operation, an exclusive cooling operation, a defrosting-drying operation, an exclusive defrosting operation, and a power-saving operation.

The simultaneous operation is described first.

The simultaneous operation may be a mode that is performed when the refrigerator is in both the cooling mode and the drying mode. The simultaneous operation may be performed when the temperature of the storage chamber R is dissatisfied in the drying mode, in which the refrigerator may supply hot air to the drying chamber D while cooling the storage chamber R.

In the simultaneous operation, the controller 150 may turn on the thermoelectric element 43, the cooling fan 44, and the heat-dissipating fan 45.

The air in the storage chamber R may be blown by the cooling fan 44 to circulate through the heat absorber 41 and the storage chamber R, thereby being able to cool the storage chamber R.

The air outside the refrigerator may be suctioned into the heat-dissipating fan space S1 of the air guide 8 by the heat-dissipating fan 45 and may be increased in temperature by absorbing heat of the heat dissipater 42 in the heat-dissipating fan space S1. The air increased in temperature by the heat dissipater 42 may pass through the through-holes 111 and 112 of the damper 10. Further, the air heated by the heat dissipater 42 may flow into the drying chamber D through the intake holes 61. The hot air flowing in the drying chamber D may dry an object to be dried in the drying chamber D and then may be discharged out of the refrigerator through the exhaust holes 62.

That is, according to the operation, it is possible to dry the inside of the drying chamber D with hot air while cooling the inside of the storage chamber R. In the simultaneous operation, it is possible to dry the drying chamber D with hot air without turning on the heater 9, so it is also possible to simultaneously cool the storage chamber and dry the drying chamber while minimizing the power consumption by the refrigerator.

In the simultaneous operation, the controller 150 may also turn on the heater 9. The present invention is not limited to necessarily keeping the heater 9 off. The controller 150 may turn on/off the heater 9, depending on the temperature of the hot air flowing into the drying chamber D in the simultaneous operation.

Hereafter, the exclusive drying operation is described.

The exclusive drying operation may be a mode that is performed when the refrigerator is in a drying mode and simultaneously not in a cooling mode or a defrosting mode. The excusive drying operation is an operation that may be performed when the temperature of the storage chamber R is satisfied in the drying mode and the defrosting mode is not entered. In the exclusive drying operation, the refrigerator may supply hot air to the drying chamber D without cooling the storage chamber R and defrosting the heat absorber 41.

The controller 150 may turn on the heat-dissipating fan 45 and the heater 9 in the exclusive drying operation. In the exclusive drying operation, the controller 150 may also turn on the thermoelectric element 43 to increase the temperature of the heat dissipater 42. However, the controller 150, in the exclusive drying operation, may keep the cooling fan 44 off to prevent overcooling of the storage chamber R.

In the exclusive drying operation, when the cooling fan 44 has been turned off, the air in the storage chamber R is not forcibly sent to the heat absorber 41 and overcooling of the storage chamber R may be minimized.

The air outside the refrigerator may be suctioned into the heat-dissipating fan space S1 of the air guide 8 by the heat-dissipating fan 45 and may be primarily heated by absorbing heat of the heat dissipater 42 in the heat-dissipating fan space S1. The air increased in temperature by the heat dissipater 42 may pass through the through-holes 111 and 112 of the damper 10 and may be secondarily heated by the heater 9. The air heated by the heat dissipater 42 and the heater 9 may flow into the drying chamber D through the intake hole 61. The hot air flowing in the drying chamber D may dry an object to be dried in the drying chamber D and then may be discharged out of the refrigerator through the exhaust holes 62.

According to the operation, it is possible to dry the inside of the drying chamber D with hot air while minimizing overcooling of the storage chamber R. In the exclusive drying operation, the heat dissipater 42 may function as a pre-heater and it is possible to more quickly dry the drying chamber D with hot air while minimizing power consumption by the heater 9.

The controller 150 may perform the exclusive drying operation in accordance with a drying mode selected by a user.

The use may select any one of a plurality of drying modes through the input unit 140 and the controller 150 may selectively perform the drying modes inputted by the user.

The drying modes may include a food drying mode and a tableware drying mode and the controller 150 may control the heater 9 such that any one of the drying mode and the tableware drying mode is higher in temperature than the other one.

In the exclusive drying operation, the controller 150 may turn on the heat-dissipating fan 45 and the heater 9 and may turn off both of the thermoelectric element 43 and the cooling fan 44.

In this case, the air outside the refrigerator may be suctioned into the heat-dissipating fan space S1 of the air guide 8 by the heat-dissipating fan 45, may pass through the through-holes 111 and 112 of the damper 10, and may be heated by the heater 9. The air heated by the heater 9 may flow into the drying chamber D through the intake holes 61. Further, the hot air flowing in the drying chamber D may dry an object to be dried in the drying chamber D and then may be discharged out of the refrigerator through the exhaust holes 62.

Hereafter, the exclusive cooling operation is described.

The exclusive cooling operation may be a mode that may be performed when the refrigerator is in the cooling mode and simultaneously not in the drying mode and the defrosting mode. The exclusive cooling operation may be performed when the temperature of the storage chamber R is not satisfied without the refrigerator in the drying mode and the defrosting mode, in which the refrigerator may cool the storage chamber R.

In the exclusive cooling operation, the controller 150 may turn on the thermoelectric element 43, the cooling fan 44, and the heat-dissipating fan 45.

The air in the storage chamber R may be blown by the cooling fan 44 to circulate through the heat absorber 41 and the storage chamber R, thereby being able to cool the storage chamber R.

The air outside the refrigerator may be suctioned into the heat-dissipating fan space S1 of the air guide 8 by the heat-dissipating fan 45 and may be increased in temperature by absorbing heat of the heat dissipater 42 in the heat-dissipating fan space S1. Some of the air increased in temperature by the heat dissipater 42 may be distributed between the heat dissipation holes 82 and the through-holes 111 and 112.

The air flowing to the heat dissipation holes 82 may be discharged out of the refrigerator by the heat dissipation holes 82. Further, the air flowing to the through-holes 111 and 112 may be discharged out of the refrigerator after passing through the drying chamber D.

Hereafter, the defrosting-drying operation is described.

The defrosting-drying operation may be a mode that is performed when the refrigerator is in both the defrosting mode and the drying mode. According to the operation, it is possible to supply hot air to the drying chamber D while defrosting the heat absorber 41.

In the defrosting-drying operation, the controller 150 may keep the thermoelectric element 43 off, may turn on the cooling fan 44 and the heat-dissipating fan 45, and may turn on the heater 9.

The air in the storage chamber R may be blown by the cooling fan 44 to circulate through the heat absorber 41 and the storage chamber R with the thermoelectric element 43 turned off, so that the heat absorber 41 may absorb heat from the air in the storage chamber R, thereby it may be gradually defrosted.

Further, the air outside the refrigerator may be suctioned into the heat-dissipating fan space S1 of the air guide 8 by the heat-dissipating fan 45, may pass through the through-holes 111 and 112 of the damper 10 from the heat-dissipating fan space S1, and may be heated by the heater 9. The air heated by the heater 9 may flow into the drying chamber D through the intake holes 61. Further, the hot air flowing in the drying chamber D may dry an object to be dried in the drying chamber D and then may be discharged out of the refrigerator through the exhaust holes 62.

That is, according to the operation, it is possible to dry the inside of the drying chamber D with hot air while defrosting the heat absorber 41.

Hereafter, the exclusive defrosting operation is described.

The exclusive defrosting operation may be a mode that is performed when the refrigerator is in the defrosting mode and simultaneously not in the drying mode. The exclusive defrosting mode may be performed when the refrigerator is in the defrosting mode and simultaneously not in the drying mode, in which the refrigerator may defrost the heat absorber 41.

In the exclusive defrosting operation, the controller 150 may turn on the cooling fan 44. In the exclusive defrosting operation, the controller 150 may keep the thermoelectric element 43, the heat-dissipating fan 45, and the heater 9 off.

The air in the storage chamber R may be blown by the cooling fan 44 to circulate through the heat absorber 41 and the storage chamber R with the thermoelectric element 43 turned off, so that the heat absorber 41 may absorb heat from the air in the storage chamber R, thereby it may be gradually defrosted.

Hereafter, the power-saving operation is described.

A user may input an instruction to select and start the power-saving operation through the input unit 140 and the power-saving operation may be performed while the refrigerator is not in the cooling mode or the defrosting mode.

In the power-saving operation, it is possible to naturally dry the drying chamber D without cooling the storage chamber R and defrosting the heat absorber 41.

In the power-saving operation, the controller 150 may turn on the heat-dissipating fan 45 and may keep the thermoelectric element 43, the cooling fan 44, and the heater 9 off.

The air outside the refrigerator may be suctioned into the heat-dissipating fan space S1 of the air guide 8 by the heat-dissipating fan 45, may pass through the through-holes 111 and 112 of the damper 10 from the heat-dissipating fan space S1, and then may flow into the heater space S2. The air flowing in the heater space S2 may flow into the drying chamber D through the intake holes 61, may naturally dry an object to be dried in the drying chamber D, and then may be discharged out of the refrigerator through the exhaust holes 62.

That is, in the power-saving operation of the refrigerator, it is possible to dry an object to be dried while minimizing power consumption.

The refrigerator may change the operation modes of the simultaneous operation, the exclusive drying operation, the exclusive cooling operation, the defrosting-drying operation, and the exclusive defrosting operation, as time passes.

For example, the temperature of the storage chamber R may enter a satisfying range while the refrigerator is operated in the simultaneous operation, and in this case, the operation of the refrigerator may be changed to the exclusive drying operation. Further, the drying mode may be finished while the refrigerator is operated in the simultaneous operation, and in this case, the operation of the refrigerator may be changed to the exclusive cooling operation. Further, if the turning-on time of the thermoelectric element 43 is a set time or more while the refrigerator is operated in the simultaneous operation, the operation of the refrigerator may be changed to the defrosting-drying operation. That is, the refrigerator may be selectively changed to the exclusive drying operation, the exclusive cooling operation, and the defrosting-drying operation while operating in simultaneous operation.

Alternatively, while the refrigerator is operated in the exclusive defrosting operation, a user may input a drying mode, and accordingly, the operation of the refrigerator may be changed to the defrosting-drying operation.

Alternatively, while the refrigerator is operated in the exclusive cooling operation, a user may input a drying mode, and accordingly, the operation of the refrigerator may be changed to the simultaneous operation.

Figure 10:
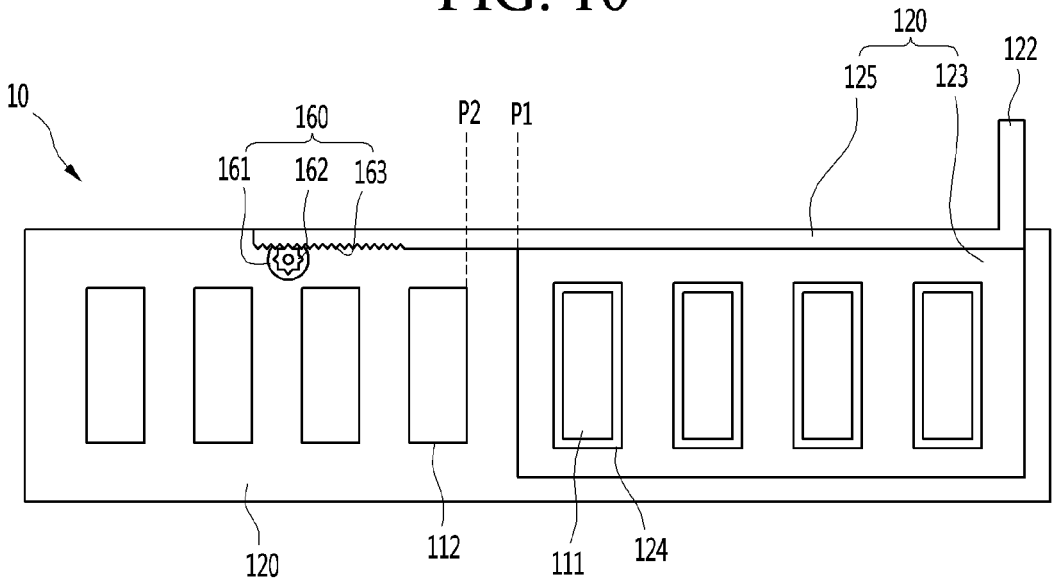
FIG. 10 is a side view showing a damper of a refrigerator according to another embodiment of the present invention.
Figure 11:
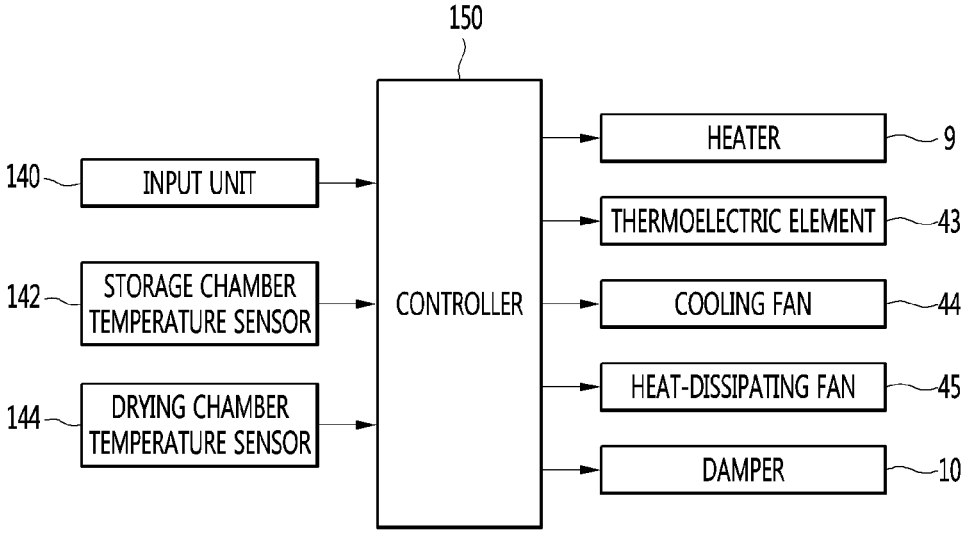
FIG. 11 is a control block diagram of the refrigerator according to another embodiment of the present invention.

FIG. 10 is a side view showing a damper of a refrigerator according to another embodiment of the present invention and FIG. 11 is a control block diagram of the refrigerator according to another embodiment of the present invention.

The damper 10 according to the embodiment may include a damper body actuator 160 that moves the damper body 120. Components and operations other than the damper body actuator 160 may be the same as those described previously in an embodiment of the present invention, so they may be given the same reference numerals and are not described in detail.

The damper body actuator 160 may be a mechanism that moves the damper body 120 linearly and may include a driving source 161 such as a motor. The driving source 161 may include a linear motor, a hydraulic cylinder, or a pneumatic cylinder connected to the damper body 120 to move the damper body 120 linearly.

The damper body actuator 160 may include at least one power transmission member that transmits power from the driving source 161 to the damper body 120. The power transmission member may include a pinion 162 connected to the rotary shaft of the driving source 161 and a rack 163 integrally formed on the damper body 120 or connected to the damper body 120 and engaged with the pinion 162.

The damper body actuator 160, particularly, the driving source 161 may be controlled by the controller 150 and the controller 150 may control the damper body actuator 160 in accordance with various operations such as the simultaneously operation, the exclusive cooling operation, and the exclusive drying operation.

The controller 150 may control the damper body actuator 160 in an opening mode in which the damper body 120 opens the first through-holes 111.

The controller 150 may control the damper body actuator 160 in a closing mode in which the damper body 120 closes the first through-holes 111.

The refrigerator may further include a drying chamber temperature sensor 144 that senses the temperature of the drying chamber.

The controller 150 may control the damper 10, particularly, the damper body actuator 160 in accordance with the temperature of the drying chamber D sensed by the drying chamber temperature sensor 144.

The controller 150 may control the damper 10, particularly, the damper body actuator 160 in an opening mode and a closing mode in accordance with the temperature of the drying chamber D sensed by the drying chamber temperature sensor 144.

When the temperature of the drying chamber D sensed by the drying chamber temperature sensor 144 is a set temperature or more, the controller 150 may control the damper 10, particularly, the damper body actuator 160 in the closing mode. Further, in this case, the flow rate of the air heated by the heat dissipater 42, which flows into the drying chamber D, may be decreased and the flow rate of the air heated by the heat dissipater 42 that is discharged through the heat dissipation holes 82 may be increased.

On the contrary, when the temperature of the drying chamber D sensed by the drying chamber temperature sensor 144 is less than the set temperature, the controller 150 may control the damper 10, particularly, the damper body actuator 160 in the opening mode. Further, in this case, the flow rate of the air heated by the heat dissipater 42, which flows into the drying chamber D, may be increased and the flow rate of the air heated by the heat dissipater 42 that is discharged through the heat dissipation holes 82 may be decreased.

Further, the controller 150 may control the damper 10, particularly, the damper body actuator 160 more precisely through step operations in accordance with the temperature of the drying chamber D sensed by the drying chamber temperature sensor 144.

In this case, the modes of the damper body actuator 160 may include a closing mode and a plurality of stepped opening modes, and the stepped opening modes may be modes in which, in each mode the opening areas of the first through-holes 111 are different.

The stepped opening modes, for example, may include a primary opening mode, a secondary opening mode in which the open areas of the first through-holes 111 are larger than those in the primary opening mode, and a third opening mode in which the open areas of the first through-holes 111 are larger than those in the secondary opening mode. In this case, the controller 150 may control the damper 10, particularly, the damper body actuator 160 in several steps comprising the primary opening mode, the secondary opening mode, and the third opening mode depending on the desired flow rate.

For example, the controller 150 may control the driving source 161 such that the open areas of the first through-holes 111 may be controlled using the several steps, and the flow rate of the air flowing into the drying chamber D may be varied based on the selected primary opening mode, the secondary opening mode, or the third opening mode.

In the control mechanism described above, the flow rate of hot air flowing into the drying chamber D may be more precisely controlled.

The refrigerator according to the embodiment, as in an embodiment of the present invention, may be selectively operated in a simultaneous operation, an exclusive drying operation, an exclusive cooling operation, a defrosting-drying operation, an exclusive defrosting operation, and a power-saving operation.

The controller 150 may open the damper 10 in the opening mode when the refrigerator is in the simultaneous operation, the exclusive drying operation, or the defrosting-drying operation.

The controller 150 may close the damper 10 in the closing mode when the refrigerator is in the exclusive cooling operation or the exclusive defrosting operation.

The controller 150 may control the damper 10 in the same or similar ways as or to an embodiment of the present invention other than the opening mode/closing mode.

When the temperature sensed by the storage chamber temperature sensor 142 is in a dissatisfying range and a drying mode is executed, the controller 150 may perform a simultaneous operation that turns on the thermoelectric element 43, the cooling fan 44, and the heat-dissipating fan 45 and opens the damper 10 in the opening mode.

When the temperature sensed by the storage chamber temperature sensor 142 is in a satisfying range and a drying mode is executed, the controller 150 may perform an exclusive drying operation that turns on the thermoelectric element 43, the heat-dissipating fan 45, and the heater 9 and opens the damper 10 in the opening mode.

When the temperature sensed by the storage chamber temperature sensor 142 is in a dissatisfying range and a drying mode is not executed, the controller 150 may perform an exclusive cooling operation that turns on the thermoelectric element 43, the cooling fan 44, and the heat-dissipating fan 45 and closes the damper 10 in the closing mode.

When the refrigerator is in both of the defrosting mode and the drying mode, the controller 150 may keep the thermoelectric element 43 off, may turn on the cooling fan 44 and the heat-dissipating fan 45, may turn on the heater 9, and may perform the defrosting-drying operation that opens the damper 10 in the opening mode.

When the refrigerator is in the defrosting mode but not in the drying mode, the controller 150 may turn on the cooling fan 44, may keep the thermoelectric element 43, the heat-dissipating fan 45, and the heater 9 off, and may perform the exclusive defrosting operation that closes the damper 10 in the closing mode.

The above description merely explains the spirit of the present invention and the present invention may be changed and modified in various ways without departing from the spirit of the present invention by those skilled in the art.

Accordingly, the embodiments described herein are provided merely not to limit, but to explain the spirit of the present invention, and the spirit of the present invention is not limited by the embodiments.

The protective right of the present invention should be construed by the following claims and the scope and spirit of the invention should be construed as being included in the patent right of the present invention.

What is claimed is:

1. A refrigerator comprising:

a main body including a storage chamber and a drying chamber;

a thermoelectric module including a heat absorber, a heat dissipater, and a thermoelectric element disposed between the heat absorber and the heat dissipater;

a cooling fan to circulate air in the storage chamber to the heat absorber and the storage chamber;

a heat-dissipating fan to blow air to the heat dissipater;

an air guide including a passage for guiding the air blown by the heat-dissipating fan to the drying chamber;

a heater disposed in the passage; and a damper to control a flow of the air blown by the heat-dissipating fan in the passage between the heat-dissipating fan and the heater, wherein the damper divides an inside of the air guide into a heat-dissipating fan space accommodating the heat-dissipating fan and a heater space accommodating the heater.

2. The refrigerator of claim 1, further comprising at least one heat dissipation hole formed at the air guide to discharge at least a portion of the air blown by the heat-dissipating fan and heated by the heat dissipater to the outside of the air guide.

3. The refrigerator of claim 1, wherein the air guide is disposed on top of the main body.

4. The refrigerator of claim 1, wherein the main body includes:

a drying chamber top plate having at least one intake hole through which the air blown by the heat dissipating fan that has passed through the heat dissipater and the heater flows into the drying chamber; and a drying chamber bottom plate having at least one exhaust hole through which the air flown into the drying chamber is discharged out of the drying chamber.

5. The refrigerator of claim 1, wherein the damper includes;

a flow path body having a plurality of first through-holes and second through-holes through which the air blown by the heat dissipating fan flows; and a damper body interacting with the flow path body to open/close the first through-holes among the plurality of first through holes and second through-holes.

6. The refrigerator of claim 5, wherein the plurality of first through-holes and second through-holes face the heater.

7. The refrigerator of claim 5, wherein an elongated length of the damper body is shorter than an elongated length of the heater.

8. The refrigerator of claim 5, wherein a handle protrudes from the damper body, and a handle hole through which the handle movably penetrates is formed at the air guide.

9. The refrigerator of claim 5, wherein the flow path body divides the heat-dissipating fan space and the heater space, and the air guide includes at least one external air suction hole through which external air is suctioned into the heat-dissipating fan space and at least one heat dissipation hole through which the air in the heat-dissipating fan space is discharged out of the air guide.

10. The refrigerator of claim 9, wherein the damper body closes the at least one heat dissipation hole when opening the first through-holes among the plurality of first through-holes and second through-holes, and opens the at least one heat dissipation hole when closing the first through-holes among the plurality of first through-holes and second through-holes.

11. The refrigerator of claim 1, further comprising:

a storage chamber temperature sensor to sense the temperature of the storage chamber; and a controller to control the thermoelectric element, the cooling fan, the heat-dissipating fan, and the heater.

12. A refrigerator comprising:

a main body including a storage chamber and a drying chamber;

a thermoelectric module including a heat absorber, a heat dissipater, and a thermoelectric element disposed between the heat absorber and the heat dissipater;

a cooling fan to circulate air in the storage chamber to the heat absorber and the storage chamber;

a heat-dissipating fan to blow air to the heat dissipater;

an air guide including a passage for guiding the air blown by the heat-dissipating fan to the drying chamber;

a heater disposed in the passage;

a damper to control a flow of the air blown by the heat-dissipating fan in the passage between the heat-dissipating fan and the heater, a storage chamber temperature sensor to sense a temperature of the storage chamber; and a controller to control the thermoelectric element, the cooling fan, the heat-dissipating fan, and the heater, wherein when the temperature sensed by the storage chamber temperature sensor is in a range that does not satisfy a target temperature and a drying mode is executed, the controller performs a simultaneous operation, in which a cooling mode and the drying mode are performed, that turns on the thermoelectric element, the cooling fan, and the heat-dissipating fan, and keeps the heater turned off.

13. The refrigerator of claim 11, wherein when the temperature sensed by the storage chamber temperature sensor is in a range that satisfies a target temperature and a drying mode is executed, the controller performs an exclusive drying operation that turns on the thermoelectric element and the heat-dissipating fan, and turns on the heater.

14. A refrigerator comprising:

a main body including a storage chamber and a drying chamber;

a thermoelectric module including a heat absorber, a heat dissipater, and a thermoelectric element disposed between the heat absorber and the heat dissipater;

a cooling fan to circulate air in the storage chamber to the heat absorber and the storage chamber;

a heat-dissipating fan to blow air to the heat dissipater;

an air guide including a passage for guiding the air blown by the heat-dissipating fan to the drying chamber;

a heater disposed in the passage;

a damper to control a flow of the air blown by the heat-dissipating fan in the passage between the heat-dissipating fan and the heater, a storage chamber temperature sensor to sense a temperature of the storage chamber; and a controller to control the thermoelectric element, the cooling fan, the heat-dissipating fan, and the heater, when a turning-on time of the thermoelectric element is a set time or more and a drying mode is executed, the controller performs a defrosting-drying operation that keeps the thermoelectric element off and turns on the cooling fan, the heat-dissipating fan, and the heater.

15. The refrigerator of claim 5, wherein the damper further includes a damper body actuator that moves the damper body to a first position where the damper body opens the first through-holes among the plurality of first through-holes and second through-holes or to a second position where the damper body closes the first through-holes among the plurality of first through-holes and second through-holes.

16. The refrigerator of claim 15, further comprising:

a storage chamber temperature sensor to sense a temperature of the storage chamber; and a controller to control the thermoelectric element, the cooling fan, the heat-dissipating fan, the heater, and the damper.

17. A refrigerator comprising:

a main body including a storage chamber and a drying chamber;

a thermoelectric module including a heat absorber, a heat dissipater, and a thermoelectric element disposed between the heat absorber and the heat dissipater;

a cooling fan to circulate air in the storage chamber to the heat absorber and the storage chamber;

a heat-dissipating fan to blow air to the heat dissipater;

an air guide including a passage for guiding the air blown by the heat-dissipating fan to the drying chamber;

a heater disposed in the passage; and a damper to control a flow of the air blown by the heat-dissipating fan in the passage between the heat-dissipating fan and the heater, wherein the damper includes;

a flow path body having a plurality of first through-holes and second through-holes through which the air blown by the heat-dissipating fan flows; and a damper body interacting with the flow path body to open/close the first through-holes among the plurality of first through holes and second through-holes, wherein the damper further includes a damper body actuator that moves the damper body to a first position where the damper body opens the first through-holes among the plurality of first through-holes and second through-holes or to a second position where the damper body closes the first through-holes among the plurality of first through-holes and second through-holes, a storage chamber temperature sensor to sense a temperature of the storage chamber; and a controller to control the thermoelectric element, the cooling fan, the heat-dissipating fan, the heater, and the damper, wherein when the temperature sensed by the storage chamber temperature sensor is in a range that does not satisfy a target temperature and a drying mode is executed, the controller performs a simultaneous operation, in which a cooling mode and the drying mode are performed, that opens the damper in an opening mode.

18. The refrigerator of claim 16, wherein when the temperature sensed by the storage chamber temperature sensor is in a range that satisfies a target temperature and a drying mode is executed, the controller performs an exclusive drying operation that opens the damper in an opening mode.

19. The refrigerator of claim 16, wherein when the temperature sensed by the storage chamber temperature sensor is in a range that does not satisfy a target temperature and a drying mode is not executed, the controller performs an exclusive cooling operation that closes the damper in a closing mode.

20. A refrigerator comprising:

a main body including a storage chamber and a drying chamber;

a thermoelectric module including a heat absorber, a heat dissipater, and a thermoelectric element disposed between the heat absorber and the heat dissipater;

a cooling fan to circulate air in the storage chamber to the heat absorber and the storage chamber;

a heat-dissipating fan to blow air to the heat dissipater;

an air guide including a passage for guiding the air blown by the heat-dissipating fan to the drying chamber;

a heater disposed in the passage; and a damper to control a flow of the air blown by the heat-dissipating fan in the passage between the heat-dissipating fan and the heater, wherein the damper includes;

a flow path body having a plurality of first through-holes and second through-holes through which the air blown by the heat-dissipating fan flows; and a damper body interacting with the flow path body to open/close the first through-holes among the plurality of first through holes and second through-holes, wherein the damper further includes a damper body actuator that moves the damper body to a first position where the damper body opens the first through-holes among the plurality of first through-holes and second through-holes or to a second position where the damper body closes the first through-holes among the plurality of first through-holes and second through-holes, a storage chamber temperature sensor to sense a temperature of the storage chamber; and a controller to control the thermoelectric element, the cooling fan, the heat-dissipating fan, the heater, and the damper, wherein when a turning-on time of the thermoelectric element is a set time or more and a drying mode is executed, the controller performs a defrosting-drying operation that opens the damper in an opening mode.

* * * * *